US005335578A

United States Patent [19]

Lorden et al.

[11] Patent Number: 5,335,578

[45] Date of Patent: Aug. 9, 1994

[54] AUTOMATIC SHELL FEEDING ATTACHMENT FOR A RELOADING MACHINE

[76] Inventors: Paul R. Lorden, 3129 Grier Nursery Rd., Forest Hill, Md. 21050; Edward L. Bonham, 1360 Quaker Church Rd., Street, Md. 21154

[21] Appl. No.: 90,320

[22] Filed: Jul. 13, 1993

[51] Int. Cl.[5] ..... F42B 33/00

[52] U.S. Cl. ..... 86/45; 86/46; 86/25; 86/28

[58] Field of Search ..... 86/45, 46, 25, 26, 27, 86/28, 24

[56] References Cited

U.S. PATENT DOCUMENTS 3,610,090 10/1971 Corcoran ..... 86/45
3,659,492 5/1972 Fullmer ..... 86/46
4,158,321 6/1979 Meacham ..... 86/45
4,328,735 5/1982 Allen ..... 86/45

*Primary Examiner*—J. Woodrow Eldred
*Attorney, Agent, or Firm*—Walter G. Finch

[57] ABSTRACT

The present invention provides a retrofitting shell feeding attachment for shotgun shell reloading machines. The invention includes a declined tray held by a forked tray support, a funnel tube member leading from a discharge port located in the tray, and a feed tube leading from the funnel tube member and into a plunger block device. The plunger block device uses a linkage mechanism joined to a shell sliding member to automatically translate the vertical reciprocating motion of a plate member on the machine into sequential horizontal motions for sliding the shells discharging from the feed tube into proper loading position underneath the plate member.

11 Claims, 6 Drawing Sheets

AUTOMATIC SHELL FEEDING ATTACHMENT FOR A RELOADING MACHINE

FIELD OF THE INVENTION

This invention relates generally to automatic reloading machines or presses for refurbishing and recharging spent shotgun shells, and more particularly, to a shell feeding attachment for use therewith.

BACKGROUND AND PRIOR ART OF THE INVENTION

Their is an increasing tendency among shotgun users to recover their spent shells and reload them on their own. To a large degree, the reasoning behind this propensity to self load old shells is simply financial, as the cost of reloading spent shells is roughly half the cost of a new shell and as a shell can often be retired approximately ten or more times. However, many shot gun enthusiasts also feel a certain internal gratification from reloading their own shells. While some will insist that the specific powder charge and shot count ratios available with self loading techniques and apparatus are more suitable to individual shooters, mostly all will confess that the very act of reloading a shotgun shell seems like a sportsman type of feat in and of itself.

The actual reloading of a spent shotgun shell or casing is a rather tedious process which entails numerous steps. These include resizing the brass or steel base portion of the shell so that it fits properly into the magazine chamber of a shotgun, discharging the old primer, inserting a new primer, filling the shell with a powder charge, lightly pressurizing the powder with a wad packing, filling the shell with a desired shot count, and crimping the top portion of the shell.

In order to facilitate this reloading process, numerous machines which provide varying degrees of automation have been invented. Often times, these shell reloading machines have been modified with various types of attachments to provide improved means for discharging the shot or powder to the shells, for feeding the primers to the shells, or for placing the shells in the machine. The Ponsness U.S. Pat. No. 3,320,848 disclose a primer cap feeder for a shell reloading machine, comprising, a cap holder tilted to gravity feed the primer caps, a chute communicating with the cap holder, and a cap feeder block. A pusher device which removes a spent primer cap and opens a slot for reception of the leading primer cap in the chute is also included as part of the Ponsness disclosure.

In his U.S. Pat. No. 3,610,090, Corcoran teaches a casing feeding apparatus for a reloading press having a stationary tool-holding head at the top of a central column and a coaxial work-holding slide carrying a turntable for properly and successively positioning casings underneath the tools positioned in the stationary head. The casing feed mechanism includes a feed tube having a throat which holds a number of casings in an end-to-end array. Upon movement of the work-holding slide, a spring-loaded plunger and detent ball mechanism releases to allow the lowest casing to gravity discharge into loading position on the turntable.

A problem with shell feeding devices which require placement of the casings or shells down through a feed tube, as does the Corcoran invention, is that the amount of shells which can be stacked one on top of the other in the tube is limited, and that operation of the reloading machine will cease when the relatively small supply of casings in the tube is exhausted. Furthermore, having to individually place the casings in the feed tube is a time consuming process that minimizes the benefit of the having the feeding device in the first place.

In response to this problem, a number of shell hopper devices in which a large number of spent casings may be placed before being automatically introduced in the proper orientation into a vertically oriented feed tube have been invented. The U.S. Pat. No. 3,659,492 issued to Fullmer teaches such an attachment. The Fullmer device includes an open, cylindrical, and inclined top hopper having a discharge port in the highest point of its lower base portion which leads to a substantially vertical feed tube. Shells are introduced into the discharge port by a rotatable plate disposed within the hopper and turned by a motor, the action of which is automatically interrupted when too many shells accumulate in the feed tube.

The Meacham U.S. Pat. No. 4,158,321 describes another casing feeder which comprises a hopper mounted to a loading tube by means of a depending sleeve and support cone. In the center of its base, the hopper has an opening slightly larger than a casing rim so that, since the center of gravity of a horizontally positioned shell is very close to its rim, the shells will tip into the opening rim-end first. The tube and hopper are maintained in an upright alignment by a tube support collar which is connected to one of the reciprocating links of the shell reloader. The vibration of the machine travels through the linkage and agitates the hopper so as to cause the shells to migrate toward the central opening. Another hopper attachment for a reloading machine which properly feeds the shells rim-end first into a feed tube as a result of the rim being the heavier of the two ends is the subject of the Ransom U.S. Pat. No. 4,455,915. The Ransom hopper has curved interior surfaces which downwardly converge at a feed opening leading below to a vertical feed tube. A transverse bar extending across the hopper and directly over the feed opening prevents shells from dropping open-end first through the feed opening and into the feed tube.

The U.S. Pat. No. 4,651,619 issued to Voecks discloses a shotgun shell reloader device having a hopper into which spent shells are oriented and stacked, and a carousel reel for serial transport of the casings to a dispenser/trip mechanism where they are individually released for convenient manual removal of the shells from the dispenser. The Voecks device is not intended to be an attachment for a shell reloading machine, but rather, an auxiliary tool to provide a steady supply of shells for the easy grasping of a reloading machine operator.

In the art of shotgun shell reloading apparatus, there exists a species of machine that requires spent shells to be fed underneath a sliding plate member carrying a turntable, and not on the top thereof. In this type of machine, the sliding plate member moves by means of a linkage mechanism in an up-and-down reciprocating motion. During its downward stroke, the sliding plate member covers and entraps a spent shotgun shell through an opening and places it in the turntable for successive operations that are to be performed as the machine proceeds. Consequently, the Corcoran invention is not suitable for use with this type of machine, as the Corcoran feed tube device is designed to release shell casings vertically on to the top portion of a turntable or shell holding device. Similarly, the Fullmer, Meacham, and Ransom casing hopper attachments disclose no way of feeding the shells underneath a turntable device, since this type of positioning requires lateral movement of the shell from the bottom of the feed tube to the proper location underneath the sliding plate member.

SUMMARY OF THE INVENTION

This invention is concerned with a casing feed attachment device which is capable of successively feeding spent shotgun shells into the type of machine described above. More specifically, the feed device has been designed to fit machines designated under the 800 and 900 series and manufactured by the Ponsness/Warren Company, a reloading machine company based in Rathdrum, Id.

Although the 800 and 900 series machines manufactured by Ponsness/Warren provide a high degree of automation in reloading spent shells, there is no available attachment for automatically feeding casings underneath the sliding plate member and into the machine. For the machines which rely on manual lever actuation, placing the shells underneath the sliding plate before pulling the lever becomes an extremely time consuming and cumbersome process. One must pull the lever, reload a casing, pull the lever, and so on. The same applies, although to a lesser extent, to machines that have been retrofitted with an optional hydraulic drive system. In this latter case, the operation of the machine by means of a foot controlled valve must still be interrupted so that spent casings may be manually fed into the machine.

The present invention accomplishes automatic feeding of the shells into the machine via a hopper tray supported by a stand, a funnel member leading from an opening in the hopper to a vertically oriented feed tube, and a unique plunger device disposed at the lower end of the feed tube. The plunger device includes a sliding member having a concave engaging end and a linkage mechanism which translates the vertical motion of the sliding plate member of the machine into a horizontal motion sufficient to laterally slide a shotgun shell underneath the sliding plate member and into its proper loading position in the machine. Means are also provided to mount the plunger device, the tray stand, and the feed tube.

OBJECTS OF THE INVENTION

It is an object of this invention to provide a novel shell feeding device for attachment to a shotgun shell reloading machine.

Another object of this invention is to provide a shell feeding device which includes a declined tray hopper, a funnel tube leading from the tray hopper, a feed tube leading from the funnel tube, and a plunger block disposed at the lower end of the feed tube.

Yet another object of this invention is to provide a shotgun shell feeding device wherein feeding action of the shells resting on the declined tray hopper occurs as a result of the vibration causes by the action of the machine.

To provide a shell feeding attachment for shotgun shell reloading machines which includes a plunger block member having a linkage mechanism which uses the vertical motion of the reloading machine to produce a horizontal sliding motion for feeding spent shells into the machine is another object of this invention.

To provide a shell feeding attachment having a plunger block mechanism which includes a sliding member having a shell engaging end curved to match the contour of the lower rim portion of a shotgun shell is yet another object of this invention.

And to provide a novel shell feeding device that will increase the productivity and efficiency of the shotgun shell reloading process is still another object of this invention.

BRIEF DESCRIPTION OF THE DRAWINGS

These and other objects and attendant advantages of this invention will become more obvious and understood from the following detailed specification and accompanying drawings, in which.

DESCRIPTION OF THE PREFERRED EMBODIMENTS OF THE INVENTION

Figure 1:
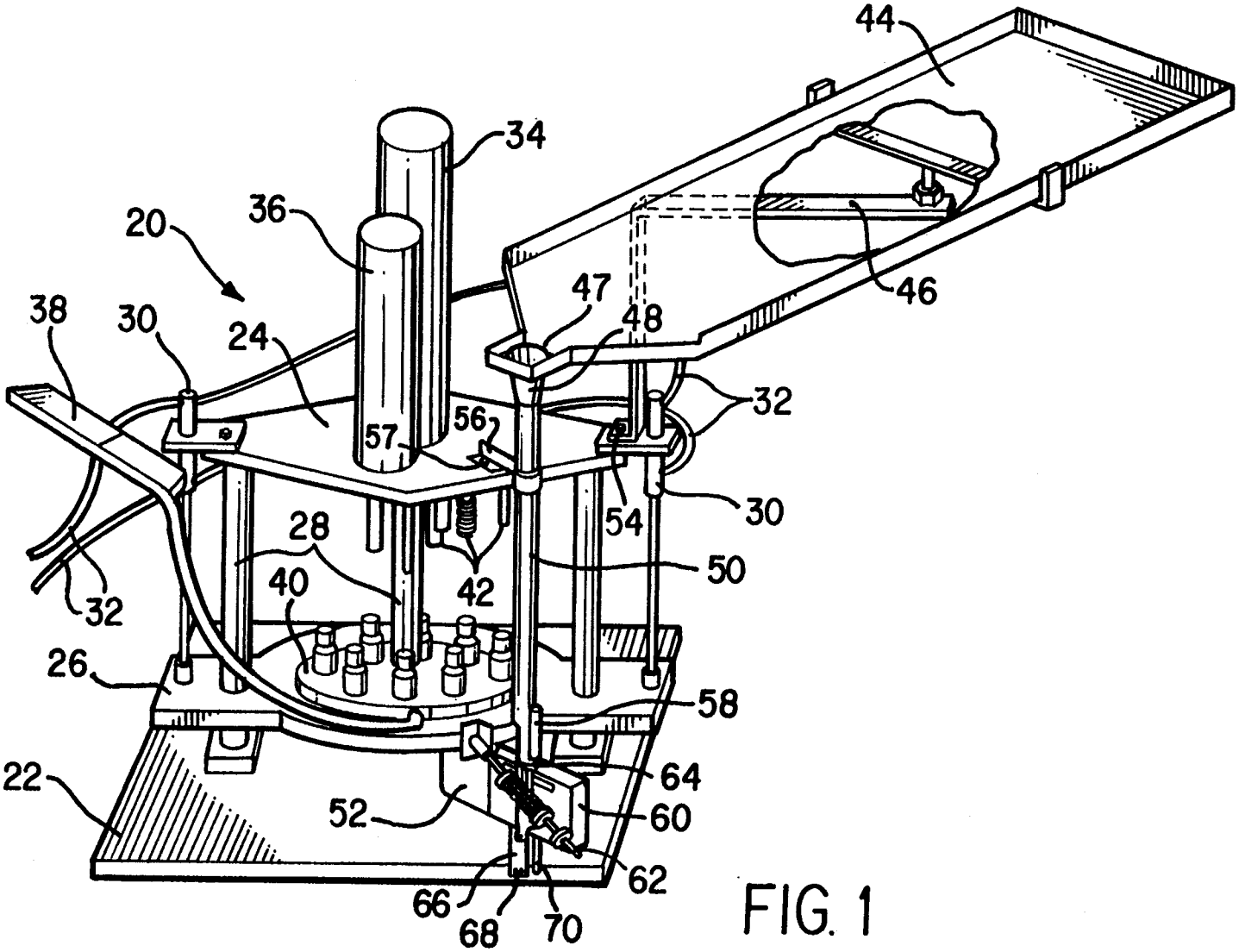
FIG. 1 is a perspective view of an automatic shell feeding device as it is attached to a shell reloading machine, incorporating novel features and embodiments of this invention.

Referring now to FIGS. 1 to 12C of the drawings, there is shown the preferred embodiment of an automatic shotgun shell feeding device for a reloading machine 20. The standard reloading machine 20 to which the present invention is applicable includes a base frame 22, an upper stationary plate 24 supported by vertical shafts 28, and a lower sliding plate 26 which supports an indexed turntable 40. On the reloading machine 20 pictured, the lower sliding plate 26 is forced to move up and down along vertical shafts 28 by means of a hydraulic drive system which includes two hydraulic cylinders 30 bolted to the upper stationary plate 24 and a number of hydraulic hoses 32. The hydraulic pump and actuation mechanism are not shown. A shot tube 34 and a powder charge tube 36 are positioned on top of the upper stationary plate 24 in order to automatically feed their contents in measured amounts through the shell tools 42. An automatic primer feeder assembly 38 is included as part of the reloading machine 20.

In operation, the reloading machine 20 lowers the lower sliding plate 26 over a spent shotgun shell in order to force it into the turntable 40, indexes the turntable 40 one turn, and raises the lower sliding plate 26 into the shell tools 42. By repeating this process, the reloading machine 20 successively performs resizing, depriming, repriming, powder filling, pressurizing, shot filling, crimping, and ejecting operations to the spent shotgun shells in turn as they rotate with the turntable 40 and engage themselves with the shell tools 42 on the upstroke of the lower sliding plate 26.

Until now, spent shotgun shells had to be individually hand fed into their proper position underneath the lower sliding plate 26 and onto a shaft member 134 surrounded by a spring 136. Naturally, this process caused unavoidable delays and interruptions in the operation of the reloading machine 20 as the operator struggled to properly place the spent shells while monitoring the other systems of the machine. The present shell feeding attachment seeks to eliminate these problems by providing an automated and continuous means of feeding the shells into the machine 20.

Figure 2:
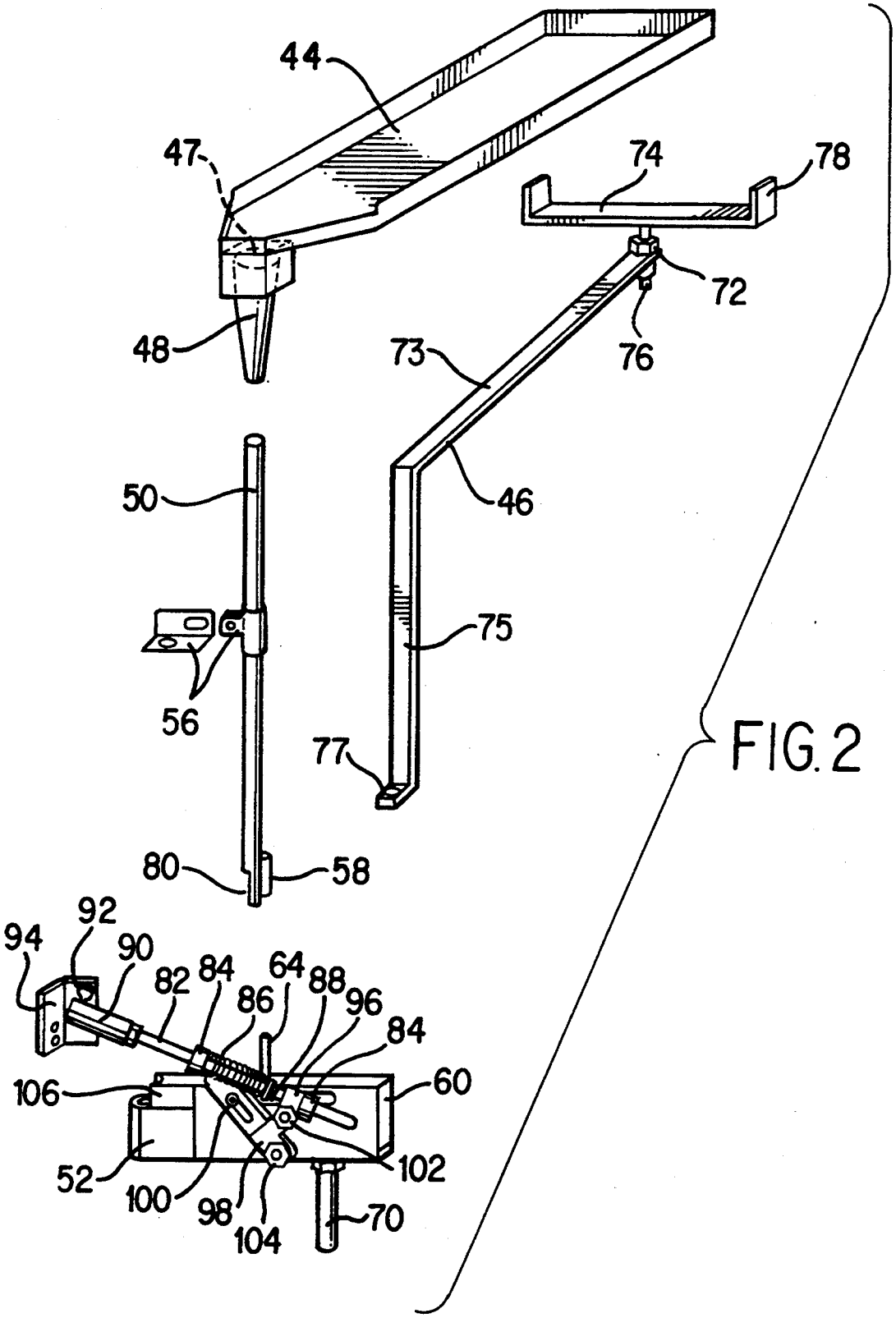
FIG. 2 is a perspective view of the automatic shell feeding device of FIG. 1 as it is detached from the shell reloading machine.

As seen in FIGS. 1 and 2, the shell feeding device attaches in four main sections: a tray hopper 44, a tray support 46, a feed tube 50, and a plunger block 52. The tray support 46 is made from a metal such as steel and is mounted to the upper stationary plate 24 with a bolt 54. For convenience in attaching the tray support 46, the bolt 54 used is the same as that which stabilizes the right hydraulic cylinder 30. The tray hopper 44 is made from a rigid plastic material, and is preferably transparent so that the machine operator may view how the shells are feeding as he or she continues to run the reloading machine 20. The tray hopper 44 rests on the tray support 46 in a declined orientation so that any shell contained within slides downward and passes through a discharge port 47 located at the lowest point of the tray hopper 44. Connected to the discharge port 47 is a funnel tube member 48 which joins into the feed tube 50 for assisting the descending shells in aligning as they enter the feed tube 50.

The feed tube 50 is supported by a clamp and bracket assembly 56 joined to the upper stationary plate 24 with a bolt 57. At the lower rear portion of the feed tube 50, there is a vertically oriented cylindrical slot 58 which receives a vertical guide shaft 64 running off of a plunger block cover 60. The plunger block cover 60 wraps around the rear and part of the upper side of the plunger block 52, and is connected thereon with two screws 62. A stabilizing stud 70 threaded into the bottom side of the plunger block 52 extends downward through an opening in a stabilizing bracket 66 attached to the machine 20 with two screws 68, and thereby helps to stabilize the rear end of the plunger block assembly 52 during operation of the reloading machine 20.

FIG. 2 shows the shell feeding device detached from the reloading machine 20. As more clearly seen in this figure, the tray support 46 includes a vertical bar member 75 joined to an inclined bar member 73. At the lower base portion of the vertical bar member 75, there is a flange member 77 having an aperture for bolting to the reloading machine 20. At the upper portion of the inclined bar member 73, there is a fork support member 74 which rotates with a shaft 76 about the opening provided in a nut 72. Two vertical bracing members 78 extend upward from the fork support member 74 to restrain the tray hopper 44 from falling off of the tray support 46 on either side.

The feed tube 50, which leads directly from the funnel tube member 48, has a lower elongate opening 80 through which a shotgun shell may slide laterally away from the primary longitudinal axis of the feed tube 50. The feed tube 50 is supported by the clamp and bracket assembly 56, and stabilized at its lower end by the insertion of the guide shaft 64 into its cylindrical slot 58.

Attached to the plunger block 52 is an L-shaped plunger block cover 60 having a guide shaft 64 which penetrates the cylindrical slot 58 provided in the feed tube 50. A stabilizing stud 70 threaded into the bottom portion of the plunger block 52 rides in an opening 130 provided in the stabilizing bracket 66 and prevents rear sway of the plunger block 52 during operation.

The linkage mechanism which operates on the plunger block 52 translates the vertical motion of the lower sliding plate 26 of the machine 20 into a horizontal motion which slides spent shells into proper position within the machine 20. This linkage mechanism includes a control rod 82 having an enlarged upper end 90 which attaches to a control plate 94 by means of a throttle ball mechanism 92. The control plate 94 is mounted with screws to the lower sliding plate 26 of the reloading machine 20 so that, when the lower sliding plate 26 is rising or falling, the throttle ball mechanism 92 translates the vertical motion of the plate 26 into a tensile or compressive force along the longitudinal axis of the control rod 82.

The middle portion of the control rod 82 includes two shaft collars 84 which., from top shaft collar 84 to bottom, are placed around a spring 86, a washer 88, and a control link 96. The control rod 82 is free to slide through the upper opening 112 provided in the control link 96 to the limit imposed by the washer 88, spring 86, and shaft collar 84 combination at one end, and by the lower shaft collar 84 at the other end.

A control arm 98 is pivotally mounted to a nut and bolt arrangement 104 at the bottom of the plunger block 52, and again pivotally joined to a second opening 114 provided in the control link 96 via a nut and bolt connection 102. A screw 100 passes through a slot 108 along the upper portion of the control arm 98, through a horizontal slot 110 along the plunger block 52, and into the side of a shell sliding member 106 arranged to slide back and forth horizontally within the plunger block 52.

Figure 4:
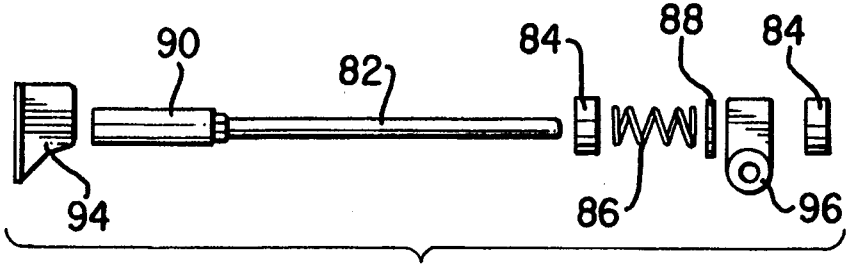
FIG. 4 is an enlarged and exploded assembly view of the control rod mechanism of the automatic shell feeding device of FIG. 1.
Figure 3A:
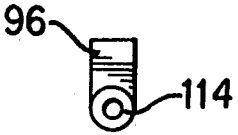
FIG. 3A is an enlarged right side elevation of the control link of the automatic shell feeding device of FIG. 1.

Detailed views of the plunger block 52 and component parts are given in FIGS. 3A through 10C. FIGS. 3A and 3B illustrate the control link 96 from two views. While the control rod 82 slides through the upper opening 112 provided in the control link 96, a nut and bolt combination 102 pivotally join the control link 96 to the control arm 98 through lower opening 114. FIG. 4 shows the control rod 82 and related parts in an exploded view. At one end of the control rod 82, the enlarged upper end 90 joins to the control plate 94 which attaches to the lower sliding plate 26 of the machine 20. At the other end, two shaft collars 84 enclose the spring 86, washer 88, and control link 96 along the middle section of the control rod 82.

Figure 7:
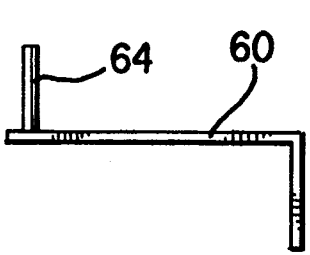
FIG. 7 is an enlarged right side elevation of the plunger block cover of the automatic shell feeding device of FIG. 1.
Figure 8D:
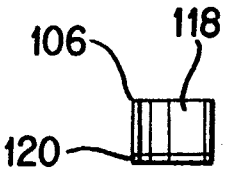
FIG. 8D is an enlarged front elevation of the shell sliding member of the automatic shell feeding device of FIG. 1.
Figure 6:
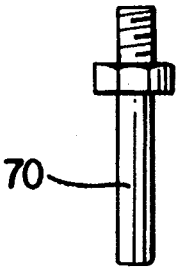
FIG. 6 is an enlarged side elevation of the stabilizing stud of the automatic shell feeding device of FIG. 1.
Figure 8C:
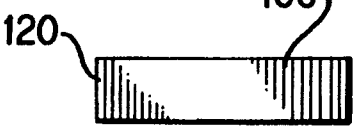
FIG. 8C is an enlarged fight side elevation of the shell sliding member of the automatic shell feeding device of FIG. 1.
Figure 3B:
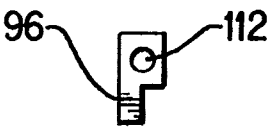
FIG. 3B is an enlarged front elevation of the control link of the automatic shell feeding device of FIG. 1.
Figure 5B:
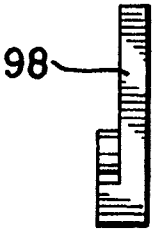
FIG. 5B is an enlarged rear elevation of the control arm of the automatic shell feeding device of FIG. 1.
Figure 8B:
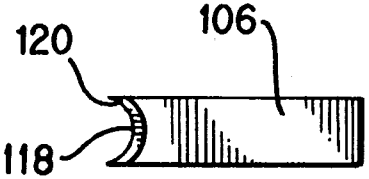
FIG. 8B is an enlarged bottom view of the shell sliding member of the automatic shell feeding device of FIG. 1.
Figure 5A:
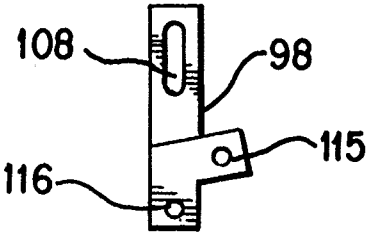
FIG. 5A is an enlarged right side elevation of the control arm of the automatic shell feeding device of FIG. 1.
Figure 8A:
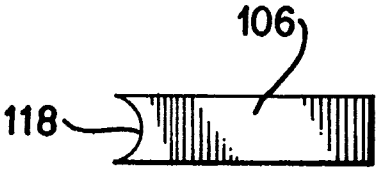
FIG. 8A is an enlarged top view of the shell sliding member of the automatic shell feeding device of FIG. 1.

FIGS. 5A and 5B show two different views of the control arm 98. The control arm 98 has a slot 108 for receiving the screw 100, a middle aperture 115 for receiving the nut and bolt combination 102 which pivotally connects it to the control link 96, and a lower aperture 116 for a pivotal mounting to the lower portion of the plunger block 52 with nut and bolt combination 104. FIG. 6 shows the stabilizer stud 70, while FIG. 7 shows the plunger block cover 60.

FIGS. 8A through 8D depict the shell sliding member 106, one of the most significant features of this invention. The shell sliding member 106 has both a curved shell engaging end 118 which conforms to the curved contour of an upright shotgun shell and a lower curved notch 120 which conforms to the curved lip on the lower metal rim portion of the same. These features allow the shell sliding member 106 to consistently slide a shotgun shell along the plunger block 52 and into proper position within the reloading machine 20.

Figure 9B:
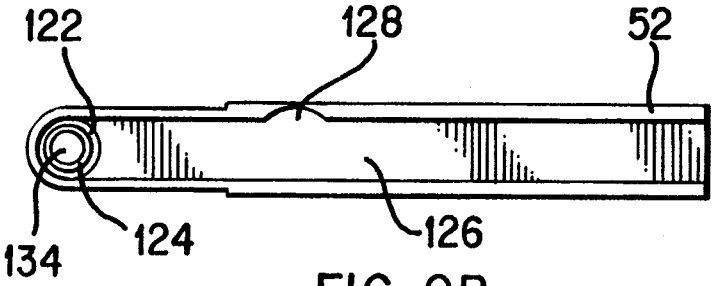
FIG. 9B is an enlarged top view of the plunger block of the automatic shell feeding device of FIG. 1.
Figure 9A:
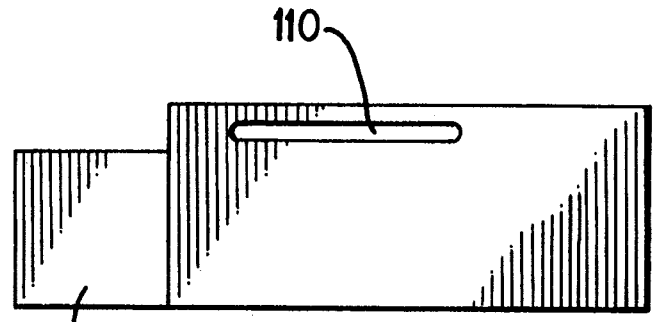
FIG. 9A is an enlarged right side elevation of the plunger block of the automatic shell feeding device of FIG. 1.

The plunger block 52, with virtually no constituent parts, is shown clearly in FIGS. 9A and 9B. FIG. 9A shows the horizontal slot 110 through which the screw 100 that taps into the shell sliding member 106 passes and slides during operation of the machine 20. The top view presented in FIG. 9B illustrates the sliding pathway 126 along which the shell sliding member 106 slides within the plunger block 52. The shells which gravity fall in the feed tube 50 individually land on the sliding pathway 126 next to a side-wall having a curved contour 128, thereby assuring proper and upright positioning of the shells as they are each pushed by the shell sliding member 106 into a counter-sunk, cylindrical bore 122 in the front end of the plunger block 52. As the shell being slid into the cylindrical bore 122 sinks toward the counter-sunk ledge, it lands on a shaft member 134 which penetrates a steel bushing 124 pressed into the cylindrical bore 122. It is important to note that the shaft member 134 is responsible for stabilizing the front end of the plunger block 52 during operation of the machine 20. Also, the positioning of the shell onto the shaft member 134 is the final location that a shell will take before entering the first reconstructive stage as it becomes lodged in the lower sliding plate 26 upon its downward stroke.

Figure 10C:
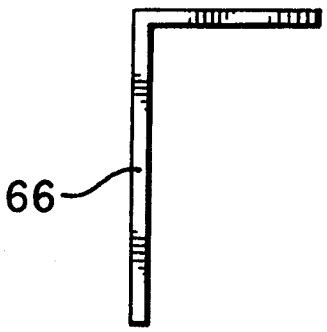
FIG. 10C is an enlarged left side elevation of the stabilizing bracket of the automatic shell feeding device of FIG. 1.
Figure 10B:
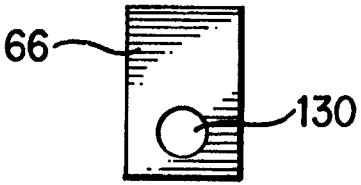
FIG. 10B is an enlarged top view of the stabilizing bracket of the automatic shell feeding device of FIG. 1.
Figure 10A:
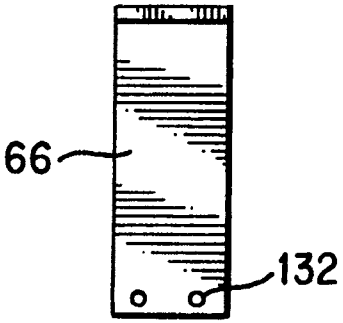
FIG. 10A is an enlarged front elevation of the stabilizing bracket of the automatic shell feeding device of FIG. 1.

FIGS. 10A through 10C show the stabilizer bracket 66 complete with mounting holes 132 and a circular opening 130. The mounting holes 132 accept screws 68 for rigid attachment of the bracket 66 to the reloading machine 20, and the circular opening 130 is fitted to slidingly receive the stabilizing stud 70 protruding from the plunger block 52.

Figure 11:
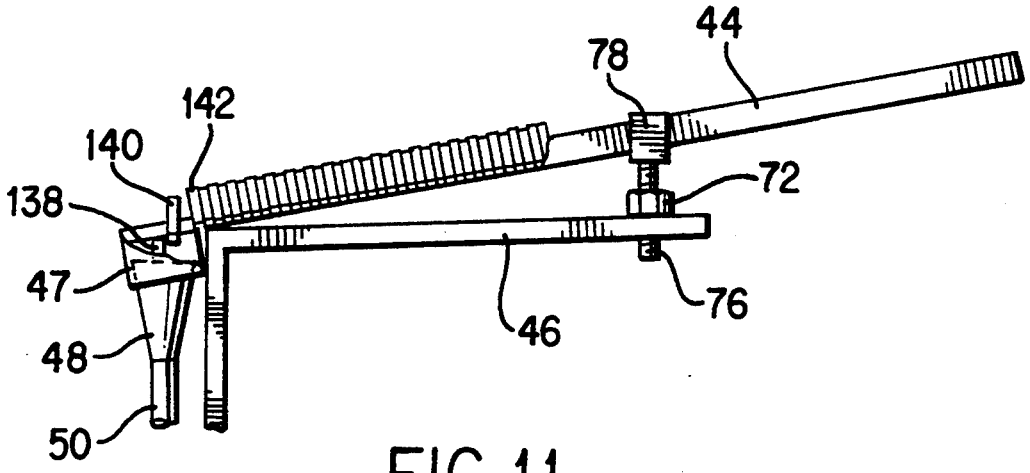
FIG. 11 is a partial right side elevation of the tray hopper and tray support of the automatic shell feeding device of FIG, 1.
Figure 12A:
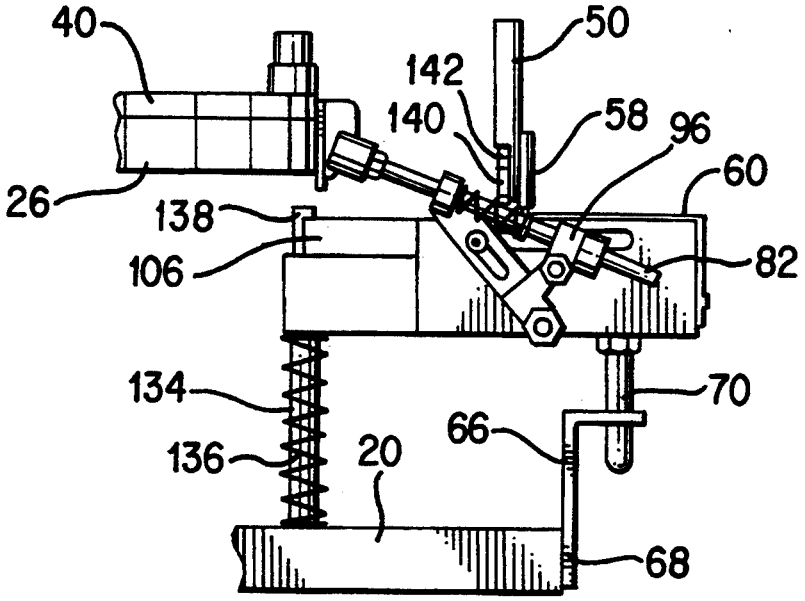
FIG. 12A is a partial right side elevation of the plunger block of the automatic shell feeding device of FIG. 1 with the reciprocating plate of the reloading machine in its upstroke.
Figure 12B:
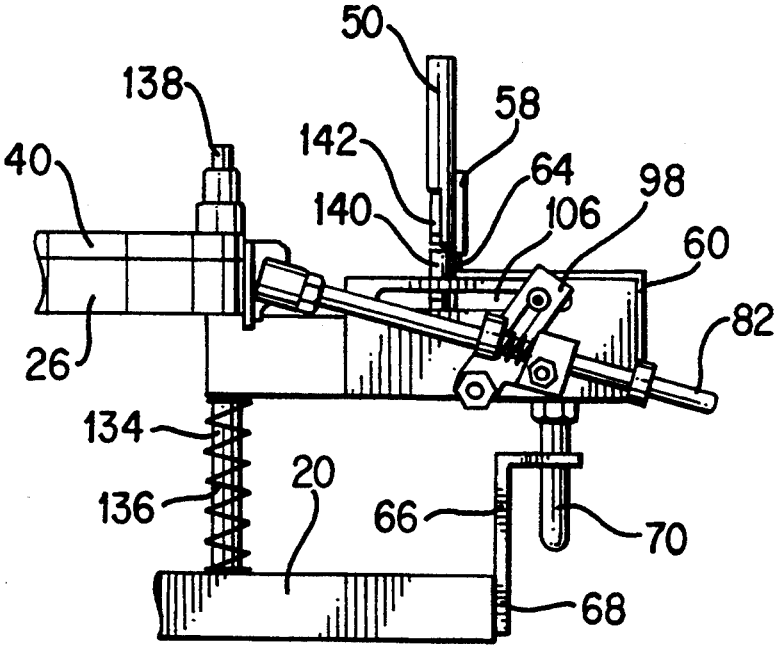
FIG. 12B is a partial right side elevation of the plunger block of the automatic shell feeding device of FIG. 1 with the reciprocating plate of the reloading machine in its downward stroke.
Figure 12C:
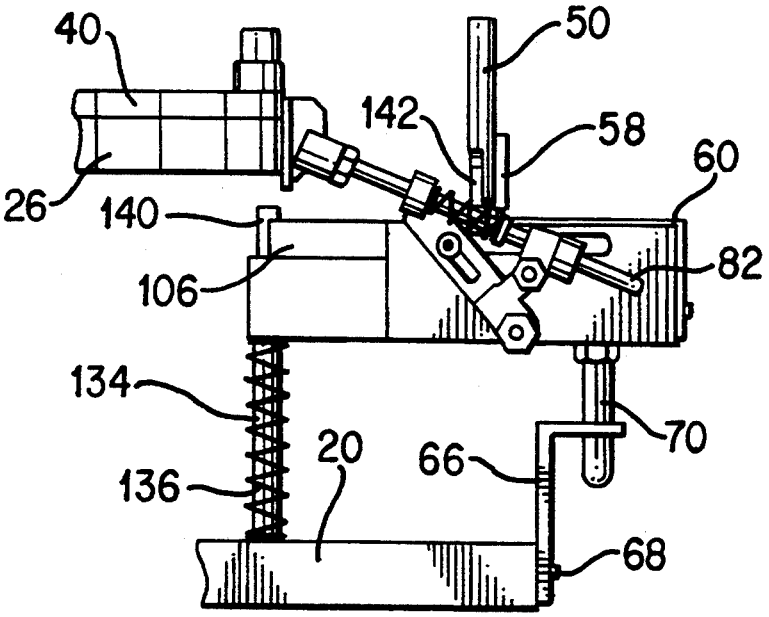
FIG. 12C is a partial right side elevation of the plunger block of the automatic shell feeding device of FIG. 1 with the reciprocating plate of the reloading machine again in its upstroke.

The feeding operation of the device is sequentially depicted in FIGS. 11 through 12C. Referring to FIG. 11, a number of spent shotgun shells have been placed in the tray hopper 44 open-end up, or rim-end down. The decline of the tray 44, together with the vibration produced by the reloading machine 20, causes the shells to migrate toward the discharge port 47, down through the funnel tube 48, and into the feed tube 50 where they will accumulate one on top of the other. The shells will remain upright as they slide into the discharge port 47 due to the low center of gravity of the spent, vertically oriented shells. In other words, the heavy metal rim-ends of the shells will keep them from tipping and falling over as they enter the discharge port 47, thus assuring consistent open-end up shell stacking within the feed tube 50. For illustrative purposes, consider three shells as they enter the discharge port 47: shell 138 having entered the funnel tube followed by shell 140 just having fallen into the discharge port 47, followed by shell 142 ready to slide down into the discharge port 47.

The shells drop through the feed tube 50 and onto the plunger block 52. As depicted in FIG. 12A, shell 138 has been pushed by shell sliding member 106 into the cylindrical bore 122 in the front section of the plunger block 52. In this position, shell 138 rests on the top surface of the shaft member 134 which is surrounded, up until the bottom surface of the plunger block 52, by a resilient spring 136. Shell 142 rests on top of shell 140, which sits on the shell sliding member 106. The lower sliding plate 26 of the machine 20 is in the peak of its upward stroke.

As seen in FIG. 12B, the lower sliding plate 26 carrying the turntable 40 has come into its downward stroke and pushed the control rod 82 into compression. The control rod 82, having slid a distance through the control link 96, forces the shell sliding member 106 to slide back into the plunger block 52 in order to allow shell 140 to drop into the curved shell engaging end 118 provided on its front portion. Meanwhile, the lower sliding plate 26 has come into contact with the front end of the plunger block 52 and forced it down against spring 136 a certain distance. Notice the travel of the stabilizing stud 70 through the stabilizer plate 66 and the movement of the vertical guide shaft 64 through the cylindrical slot 58. During this motion, the shaft member 134 pushes against the bottom surface of shell 138 and lodges it into the turntable 40 through the lower sliding plate 26.

In FIG. 12C, the lower sliding plate 26 has resumed its upstroke and pulled the control rod 82 into tension, thus pushing shell 140 via the shell sliding member 106 into proper loading position in the cylindrical bore 122. Note how shell 142 is now allowed to drop onto the top surface of the shell sliding member 106 and will drop in front of the curved shell engaging end 118 upon the next downstroke of the lower sliding plate 26. The action of the spring 136 forces the entire plunger block 52 back up and into its former position.

It should be clear that the present invention is not limited to the previous descriptions and drawings which merely illustrate the preferred embodiment thereof. Slight departures may be made within the scope of the invention. Accordingly, the present invention is meant to embrace any and all equivalent apparatus as well as all design alterations as set forth in the appended claims.

What is claimed is:

1. An automatic shotgun shell feeding attachment for use with a shotgun shell reloading machine having a vertically reciprocating plate member, comprising, hopper means in the form of a tray member, hopper support means, vertically oriented feed tube means leading from said hopper means and having both an upper opening and a lower opening, and a plunger block means disposed at the lower portion of said feed tube means, wherein said plunger block means includes shell sliding means, whereby said plunger block means further includes linkage means connected to said shell sliding means and attachable to said vertically reciprocating plate member of said reloading machine, wherein said linkage means translates the up and down motion of said vertically reciprocating plate member into horizontal motion through said shell sliding means, whereby said hopper means has lower surfaces which converge toward a shell discharge port, and wherein said linkage means comprises:

control rod means having joined to its upper end a throttle ball mechanism connected to a control plate having a number of apertures for accepting bolts for rigid attachment to said vertically reciprocating plate member of said reloading machine;

a number of shaft collars spaced along the middle portion of said control rod means;

spring means disposed between said shaft collars;

control link means disposed between said shaft collars and having both a first aperture accepting said control rod means and a second aperture running at a right angle with respect to said first aperture;

control arm means having an upper elongated portion with a slot cut therealong, a middle portion pivotally connected to said second aperture of said control link means, and a lower portion having an aperture for pivotal attachment to a base rod member extending laterally from the lower portion of said plunger block means; and screw means passing through said slot on said upper elongated portion of said control arm means and into said shell sliding means.

2. An automatic shotgun shell feeding attachment for use with a shotgun shell reloading machine having a vertically reciprocating plate member, comprising, hopper means in the form of a tray member, hopper support means, vertically oriented feed tube means leading from said hopper means and having both an upper opening and a lower opening, and a plunger block means disposed at the lower portion of said feed tube means, wherein said plunger block means includes shell sliding means, whereby said plunger block means further includes linkage means connected to said shell sliding means and attachable to said vertically reciprocating plate member of said reloading machine, wherein said linkage means translates the up and down motion of said vertically reciprocating plate member into horizontal motion through said shell sliding means, whereby said hopper means has lower surfaces which converge toward a shell discharge port, wherein said plunger block means has a vertically oriented stabilizing stud connected to its lower base portion, whereby said plunger block means has a block cover made from two plates joined at right angles covering a portion of its top and rear sides, and wherein said block cover has a thin rod member extending upwardly and positioned to slidingly penetrate a cylindrical feed tube slot located on the lower portion of said feed tube means.

3. An automatic shotgun shell feeding attachment for use with a shotgun shell reloading machine having a vertically reciprocating plate member as recited in claim 2, wherein said shell feeding attachment further comprises a plunger block stabilizing bracket made from two plates of metal joined at right angles, whereby said plunger block stabilizing bracket includes an aperture in its top section through which said vertically oriented stabilizing stud may slidingly pass, and wherein said plunger block stabilizing bracket includes a multiplicity of apertures in its lower section through which bolting means may pass for attachment of said plunger block stabilizing bracket to said reloading machine.

4. An automatic shotgun shell feeding attachment for use with a shotgun shell reloading machine having a vertically reciprocating plate member, comprising, tray hopper means having lower surfaces which converge toward a shell discharge port, tray hopper support means, vertically oriented feed tube means leading from said tray hopper means and having both an upper opening and a lower opening, and plunger block means disposed at the lower portion of said feed tube means, said plunger block means including a shell sliding block member having an inwardly curved engaging end, said plunger block means further including linkage means connected to said shell sliding block member and attachable to said vertically reciprocating plate member of said reloading machine, wherein said linkage means comprises:

a control rod having joined to its upper end a throttle ball mechanism connected to a control plate having a number of apertures for accepting screws for rigid attachment to said vertically reciprocating plate member of said reloading machine;

two shaft collars spaced along the middle portion of said control rod;

a spring disposed between said shaft collars;

a control link disposed between said shaft collars having both a first aperture accepting said control rod and a second aperture running at a right angle with respect to said first aperture;

a control arm having an upper elongated portion with a slot cut therealong, a middle portion pivotally connected to said second aperture of said control link, and a lower portion having an aperture for pivotal attachment to a base rod member extending laterally from the lower portion of said plunger block means; and a screw passing through said slot on said upper elongated portion of said control arm, through a horizontally positioned slot in said plunger block means, and into said shell sliding block member.

5. An automatic shotgun shell feeding attachment for use with a shotgun shell reloading machine having a vertically reciprocating plate member as recited in claim 4, wherein said shotgun shell feeding attachment further comprises a funnel tube member joining said shell discharge port of said tray hopper means to said upper opening of said feed tube.

6. An automatic shotgun shell feeding attachment for use with a shotgun shell reloading machine having a vertically reciprocating plate member as recited in claim 4, wherein said tray hopper support means comprises a vertical support bar having joined to its lower end a flange member extending perpendicularly from said vertical support bar and including a number of apertures for receiving bolting means for rigid attachment to said reloading machine, an inclined bar leading from said vertical support bar, and a rotatable fork support joined to said inclined bar, wherein said rotatable fork support member has a plurality of vertical bracing members for stabilizing said tray hopper means.

7. An automatic shotgun shell feeding attachment for use with a shotgun shell reloading machine having a vertically reciprocating plate member as recited in claim 4, whereby said shell feeding attachment further comprises a feed tube clamp and mounting bracket assembly, wherein said lower opening of said feed tube includes an elongated open portion cut along the length of one side of said feed tube, and whereby a cylindrical feed tube slot is joined to the lower end of said feed tube directly opposite from said elongated open portion.

8. An automatic shotgun shell feeding attachment for use with a shotgun shell reloading machine having a vertically reciprocating plate member as recited in claim 4, wherein said shell sliding block member slides back and forth in a recess provided in said plunger block means.

9. An automatic shotgun shell feeding attachment for use with a shotgun shell reloading machine having a vertically reciprocating plate member as recited in claim 4, wherein said plunger block means has a vertically oriented stabilizing stud protruding downward from its lower base portion, whereby said plunger block means has a block cover made from two plates joined at right angles covering a portion of its top and rear sides, and wherein said block cover has a thin rod member extending upwardly from its top plate member so as to slidingly penetrate a cylindrical feed tube slot located on the lower portion of said feed tube.

10. An automatic shotgun shell feeding attachment for use with a shotgun shell reloading machine having a vertically reciprocating plate member as recited in claim 4, wherein said plunger block means further includes a curved frontal section having a cylindrical bore containing a steel bushing.

11. An automatic shotgun shell feeding attachment for use with a shotgun shell reloading machine having a vertically reciprocating plate member as recited in claim 9, wherein said shell feeding attachment further comprises a plunger block stabilizing bracket made from two plates of metal joined at right angles, whereby said plunger block stabilizing bracket includes an aperture in its top section through which said vertically oriented stabilizing stud of said plunger block means may slidingly pass, and wherein said plunger block stabilizing bracket includes a multiplicity of apertures in its lower section through which bolting means may pass for attachment of said plunger block stabilizing bracket to said reloading machine.

* * * * *